US009754536B2

(12) United States Patent
Chang et al.

(10) Patent No.: US 9,754,536 B2
(45) Date of Patent: Sep. 5, 2017

(54) ORGANIC LIGHT EMITTING DISPLAY DEVICE

(71) Applicant: LG DISPLAY CO., LTD., Seoul (KR)

(72) Inventors: Min Kyu Chang, Incheon (KR); Shinji Takasugi, Paju-si (KR); Hyo Jin Park, Yeosu-si (KR); Jong Ho Lee, Seoul (KR)

(73) Assignee: LG Display Co., Ltd., Seoul (KR)

( * ) Notice: Subject to any disclaimer, the term of this patent is extended or adjusted under 35 U.S.C. 154(b) by 219 days.

(21) Appl. No.: 14/806,386

(22) Filed: Jul. 22, 2015

(65) Prior Publication Data

US 2016/0042690 A1 Feb. 11, 2016

(30) Foreign Application Priority Data

Aug. 6, 2014 (KR) ..... 10-2014-0101135

(51) Int. Cl.
*G09G 3/3258* (2016.01)
*G09G 3/3233* (2016.01)
*G09G 3/3291* (2016.01)

(52) U.S. Cl.
CPC ..... *G09G 3/3258* (2013.01); *G09G 3/3233* (2013.01); *G09G 3/3291* (2013.01); *G09G 2300/043* (2013.01); *G09G 2300/0819* (2013.01); *G09G 2310/0251* (2013.01); *G09G 2320/043* (2013.01)

(58) Field of Classification Search
CPC ..... G09G 2320/045
See application file for complete search history.

(56) References Cited

U.S. PATENT DOCUMENTS 7,982,695 B2 7/2011 Mizukoshi et al.
8,026,876 B2 * 9/2011 Nathan ..... G09G 3/3233 315/169.3
8,274,503 B2 * 9/2012 Kwon ..... G09G 3/3233 345/214
8,279,143 B2 * 10/2012 Nathan ..... G09G 3/3233 315/169.3
8,294,696 B2 * 10/2012 Min ..... G09G 3/3233 345/204

(Continued)

FOREIGN PATENT DOCUMENTS

CN 103854603 A 6/2014
GB 2504163 A 1/2014
KR 10-2012-0076215 A 7/2012

*Primary Examiner* — Patrick F Marinelli
(74) *Attorney, Agent, or Firm* — Dentons US LLP

(57) ABSTRACT

An organic light emitting display device includes a display panel including a plurality of pixels, wherein each pixel includes a driving transistor outputting a data current based on a data voltage to emit light from an organic light emitting diode; and a panel driver which drives the display panel in a sensing mode and a display mode, wherein the panel driver calculates a threshold voltage prediction value of the driving transistor for each pixel by sensing a mobility and a threshold voltage of the driving transistor for each pixel through a reference line connected with a sensing node between the driving transistor and the organic light emitting diode of each pixel for the sensing mode, and the panel driver drives each pixel based on the threshold voltage prediction value of the driving transistor of each pixel for the display mode.

20 Claims, 8 Drawing Sheets

(56) References Cited

U.S. PATENT DOCUMENTS 8,334,826 B2 * 12/2012 Min ..... G09G 3/3233 315/169.3
8,558,767 B2 * 10/2013 Kwon ..... G09G 3/3233 315/169.3
8,581,809 B2 * 11/2013 Nathan ..... G09G 3/3233 315/169.3
9,030,387 B2 * 5/2015 Jeong ..... G09G 3/3233 345/690
9,041,705 B2 * 5/2015 Han ..... G09G 3/3233 345/212
9,053,668 B2 * 6/2015 Yoon ..... G09G 3/3258
9,111,489 B2 * 8/2015 Park ..... G09G 3/3233
9,111,491 B2 * 8/2015 Woo ..... G09G 3/3233
9,125,278 B2 * 9/2015 Nathan ..... G09G 3/3233
9,202,411 B2 * 12/2015 Jung ..... G09G 3/3208
9,236,011 B2 * 1/2016 Mizukoshi ..... G09G 3/3291
9,286,834 B2 * 3/2016 Yoon ..... G09G 3/3291
9,305,494 B2 * 4/2016 Shim ..... G09G 3/3233
9,349,317 B2 * 5/2016 Kim ..... G09G 3/3233
9,390,652 B2 * 7/2016 Chang ..... G09G 3/3233
9,396,675 B2 * 7/2016 Kim ..... G09G 3/006
9,437,167 B2 * 9/2016 Shin ..... G09G 3/3233
9,460,661 B2 * 10/2016 Shim ..... G09G 3/3233
9,478,197 B2 * 10/2016 Lim ..... G09G 5/397
9,489,888 B2 * 11/2016 Kim ..... G09G 3/3233
9,489,893 B2 * 11/2016 Tan ..... G09G 3/3258
9,514,685 B2 * 12/2016 Yoon ..... G09G 3/3283
9,530,352 B2 * 12/2016 Nathan ..... G09G 3/3233
9,542,873 B2 * 1/2017 Yu ..... G09G 3/006
9,558,717 B2 * 1/2017 Takasugi ..... G09G 5/18
9,583,043 B2 * 2/2017 Mizukoshi ..... G09G 3/3283
2008/0048951 A1 * 2/2008 Naugler ..... G09G 3/006 345/82
2008/0088648 A1 * 4/2008 Nathan ..... G09G 3/3233 345/690
2009/0027377 A1 * 1/2009 Kwon ..... G09G 3/3233 345/214
2010/0033511 A1 * 2/2010 Yamashita ..... G09G 3/3233 345/690
2010/0073335 A1 * 3/2010 Min ..... G09G 3/3233 345/204
2010/0073357 A1 * 3/2010 Min ..... G09G 3/3233 345/214
2010/0188390 A1 * 7/2010 Min ..... G09G 3/3233 345/212
2011/0279488 A1 * 11/2011 Nathan ..... G09G 3/3233 345/690
2012/0293478 A1 * 11/2012 Chaji ..... G09G 3/3258 345/212
2013/0050292 A1 * 2/2013 Mizukoshi ..... G09G 3/3291 345/690
2013/0057595 A1 * 3/2013 Nathan ..... G09G 3/3233 345/690
2013/0120228 A1 * 5/2013 Yoon ..... G09G 3/3291 345/80
2013/0127692 A1 * 5/2013 Yoon ..... G09G 3/3258 345/80
2013/0169699 A1 * 7/2013 Jeong ..... G09G 3/3233 345/690
2014/0022289 A1 * 1/2014 Lee ..... G09G 3/3283 345/691
2014/0035488 A1 * 2/2014 Nathan ..... G09G 3/3233 315/307
2014/0035799 A1 * 2/2014 Bae ..... G09G 3/3266 345/82
2014/0139510 A1 * 5/2014 Han ..... G09G 3/3233 345/212
2014/0152633 A1 6/2014 Park et al.
2014/0176400 A1 * 6/2014 Park ..... G09G 3/3233 345/76
2014/0176401 A1 * 6/2014 Kim ..... G09G 3/3208 345/76
2014/0176409 A1 * 6/2014 Kim ..... G09G 3/3233 345/92
2014/0176516 A1 * 6/2014 Kim ..... G09G 3/3233 345/204
2014/0176525 A1 * 6/2014 Woo ..... G09G 3/3233 345/212
2014/0176622 A1 * 6/2014 Jung ..... G09G 3/3208 345/690
2014/0340436 A1 * 11/2014 Kumeta ..... G09G 3/3291 345/691
2015/0002502 A1 * 1/2015 Kim ..... G09G 3/3233 345/212
2015/0049075 A1 * 2/2015 Lim ..... G09G 5/397 345/212
2015/0123953 A1 * 5/2015 Shim ..... G09G 3/3233 345/205
2015/0130785 A1 * 5/2015 Shin ..... G09G 3/3233 345/213
2015/0154908 A1 * 6/2015 Nam ..... G09G 3/3233 345/76
2015/0170569 A1 * 6/2015 Han ..... G09G 3/3258 345/78
2015/0170578 A1 * 6/2015 Choi ..... G09G 3/3266 345/212
2015/0179102 A1 * 6/2015 Kim ..... G09G 3/3233 345/77
2015/0179105 A1 * 6/2015 Mizukoshi ..... G09G 3/3266 345/76
2015/0179106 A1 * 6/2015 Yoon ..... G09G 3/3283 345/77
2015/0179107 A1 * 6/2015 Kim ..... G09G 3/3233 345/212
2015/0187273 A1 * 7/2015 Chang ..... G09G 3/3233 345/690
2015/0187274 A1 * 7/2015 Kim ..... G09G 3/3258 345/212
2015/0187276 A1 * 7/2015 Shim ..... G09G 3/3233 345/77
2015/0187278 A1 * 7/2015 Park ..... G09G 3/3291 345/212
2015/0325174 A1 * 11/2015 Yu ..... G09G 3/3233 345/77
2015/0339978 A1 * 11/2015 Nathan ..... G09G 3/3233 345/78
2015/0379939 A1 * 12/2015 Takasugi ..... G09G 5/18 345/690
2016/0005354 A1 * 1/2016 Takasugi ..... G09G 3/3291 345/207
2016/0012800 A1 * 1/2016 Han ..... G09G 3/3208 345/213
2016/0042690 A1 * 2/2016 Chang ..... G09G 3/3258 345/212
2016/0055797 A1 * 2/2016 Tan ..... G09G 3/3258 345/206
2016/0062548 A1 * 3/2016 Kwon ..... G06F 3/0418 345/173
2016/0063910 A1 * 3/2016 An ..... G09G 3/3233 345/691
2016/0071445 A1 * 3/2016 Kim ..... G09G 3/006 345/212
2016/0078813 A1 * 3/2016 Mizukoshi ..... G09G 3/3283 345/76
2016/0086539 A1 * 3/2016 Mizukoshi ..... G09G 3/3291 345/690
2016/0098961 A1 * 4/2016 Han ..... G09G 3/3291 345/691
2016/0125800 A1 * 5/2016 Kim ..... G09G 3/3225 345/212
2016/0125811 A1 * 5/2016 Park ..... G09G 3/3258 345/694
2016/0189595 A1 * 6/2016 Choi ..... G09G 3/2092 345/212
2016/0189614 A1 * 6/2016 Tani ..... G09G 3/3258 345/211
2016/0189615 A1 * 6/2016 Kwon ..... G09G 3/3258 345/214

(56) References Cited

U.S. PATENT DOCUMENTS

| | | | | |
|---|---|---|---|---|
| 2016/0189621 | A1* | 6/2016 | Kim | G09G 3/3258<br>345/215 |
| 2016/0189622 | A1* | 6/2016 | Lee | G09G 3/3233<br>345/212 |
| 2016/0189629 | A1* | 6/2016 | Jin | G09G 3/3233<br>345/211 |
| 2016/0189630 | A1* | 6/2016 | Chang | G09G 3/3291<br>345/211 |
| 2016/0240122 | A1* | 8/2016 | Yu | G09G 3/006 |
| 2016/0351095 | A1* | 12/2016 | Tani | G09G 3/3275 |

* cited by examiner

ORGANIC LIGHT EMITTING DISPLAY DEVICE

CROSS REFERENCE TO RELATED APPLICATIONS

This application claims the benefit of the Korean Patent Application No. 10-2014-0101135 filed on Aug. 6, 2014, which is incorporated by reference in its entirety for all purposes as if fully set forth herein.

BACKGROUND

Field of the Disclosure

Embodiments of the present invention relate to an organic light emitting display device. More particularly, the invention relates to an organic light emitting display device that compensates for variations of a driving transistor in each pixel of the display device.

Discussion of the Related Art

Due to recent developments in multimedia, there is an increasing demand for flat panel displays. In order to satisfy the increasing demand, various flat panel displays such as liquid crystal displays, plasma display panels, field emission displays, and organic light emitting displays are practically used. Among the various flat panel displays, the organic light emitting display device is attractive as a next-generation flat panel display because of its rapid response speed and low power consumption. In addition, the organic light emitting display device self-emits light and does not cause a problem related with narrow viewing angles.

FIG. 1 is a circuit diagram illustrating a pixel structure of an organic light emitting display device according to the related art.

Referring to FIG. 1, a pixel (P) of the organic light emitting display device according to the related art may include a switching transistor (Tsw), a driving transistor (Tdr), a capacitor (Cst), and an organic light emitting diode (OLED).

The switching transistor (Tsw) is switched by a scan pulse (SP) supplied via a scan line (SL), the switching transistor (Tsw) supplies a data voltage (Vdata) supplied via a data line (DL) to the driving transistor (Tdr). The driving transistor (Tdr) is switched by the data voltage (Vdata) supplied from the switching transistor (Tsw), to control a data current (Ioled) flowing from a driving power source (EVdd) to the organic light emitting diode (OLED). The capacitor (Cst) is connected between gate and source terminals of the driving transistor (Tdr), wherein the capacitor (Cst) stores a voltage corresponding to the data voltage (Vdata) supplied to the gate terminal of the driving transistor (Tdr), and turns on the driving transistor (Tdr) with the stored voltage. The organic light emitting diode (OLED) is electrically connected between the source terminal of the driving transistor (Tdr) and a cathode line (EVss), wherein the organic light emitting diode (OLED) emits light from the data current (Ioled) supplied from the driving transistor (Tdr). In each pixel (P) of the organic light emitting display device according to the related art, a level of the data current (Ioled) flowing from the driving power source (EVdd) to the organic light emitting diode (OLED) is controlled by switching the driving transistor (Tdr) according to the data voltage (Vdata) so that the organic light emitting diode (OLED) emits light to display a predetermined image.

In the case of the organic light emitting display device according to the related art, the characteristics of threshold voltage (Vth)/mobility in the driving transistor (Tdr) may different at each pixel position of an organic light emitting display panel due to non-uniformity of the thin-film transistors caused by manufacturing process variation. Accordingly, even though the same data voltage (Vdata) is applied to the driving transistor (Tdr) for each pixel in the organic light emitting display device according to the related art, it is difficult to realize uniformity in picture quality due to deviations of the current flowing in the organic light emitting diode (OLED).

In order to overcome these problems, Korean Patent Publication Number 10-2012-0076215 (hereinafter, referred to as 'prior-art document') discloses an organic light emitting display device and an external compensation method in which a sensor transistor is additionally provided in each pixel, a threshold voltage of a driving transistor is sensed through the use of a reference line connected to the sensor transistor by switching the sensor transistor and switching transistor, and variations of the threshold voltage of the driving transistor are compensated.

In the organic light emitting display device of the prior-art document, the change of threshold voltage in the driving transistor is sensed based on a value sensed in an analog-to-digital converter by driving the driving transistor for each pixel in a source follower mode, and then the threshold voltage of the driving transistor is compensated.

However, in the case of the above sensing method of the prior-art document, a sensing voltage is saturated after a sufficient time period due to an influence of capacitance. Thus, in order to accurately compensate for the threshold voltage of the driving transistor, the voltage saturation should be delayed until the driving transistor is turned-off. However, this causes sensing speed to be slower due to the increase of sensing time.

SUMMARY

Accordingly, embodiments of the present invention are directed to an organic light emitting display device that substantially obviates one or more problems due to limitations and disadvantages of the related art.

Aspects of embodiments of the present invention are directed to provide an organic light emitting display device which facilitates shortening sensing time of a driving transistor.

Additional advantages and features of embodiments of the invention will be set forth in part in the description which follows and in part will become apparent to those having ordinary skill in the art upon examination of the following or may be learned from practice of embodiments of the invention. The objectives and other advantages of embodiments of the invention may be realized and attained by the structure particularly pointed out in the written description and claims hereof as well as the appended drawings.

To achieve these and other advantages and in accordance with the purpose of embodiments of the invention, as embodied and broadly described herein, there is provided an organic light emitting display device that includes a display panel including a plurality of pixels, wherein each pixel includes a driving transistor outputting a data current from a data voltage to emit light from an organic light emitting diode; and a panel driver for driving the display panel in a sensing mode and a display mode, wherein, the sensing mode, the panel driver calculates a threshold voltage prediction value of the driving transistor for each pixel by sensing a mobility and a threshold voltage of the driving transistor for the pixel through a reference line connected to a sensing node between the driving transistor and the organic light emitting diode of the pixel, wherein, in the display mode, the panel driver drives each pixel based on the threshold voltage prediction value of the pixel, and wherein the panel driver senses the mobility and the threshold voltage of the driving transistor at a shortened sensing time before a voltage saturation time at which a sensing voltage in accordance with a current flowing in the driving transistor is saturated, and calculates the threshold voltage prediction value for each pixel corresponding to the voltage saturation time on the basis of a threshold voltage sensing value of the driving transistor for each pixel, a mobility sensing value of the driving transistor for each pixel, and a capacitance of the reference line.

Another aspect of the invention includes a method of driving an organic light emitting display device, the display device including a display panel and a panel driver, the display panel includes a plurality of pixels, each pixel including a driving transistor and an organic light emitting diode, the method comprising in a sensing mode, calculating a threshold voltage prediction value of a driving transistor for each pixel by sensing a mobility and a threshold voltage of the driving transistor for the pixel through a reference line connected to a sensing node between the driving transistor and an organic light emitting diode of the pixel, and, in a display mode, the panel driver drives each pixel based on the threshold voltage prediction value of the pixel, wherein the panel driver senses the mobility and the threshold voltage of the driving transistor at a shortened sensing time before a voltage saturation time at which a sensing voltage in accordance with a current flowing in the driving transistor is saturated, and calculates the threshold voltage prediction value for each pixel corresponding to the voltage saturation time on the basis of a threshold voltage sensing value of the driving transistor for each pixel, a mobility sensing value of the driving transistor for each pixel, and a capacitance of the reference line.

In yet another aspect of the current invention, a panel driver for driving a display panel in a sensing mode and a display mode, comprises a timing controller for driving a row driver and a column driver of the display panel; the row driver for generating and supplying scan pulses to scan lines of the display panel based on a row driver control signal from the timing controller; the column driver for supplying data voltage to data lines of the display panel based on a column driver data control signal from the timing controller in the display mode, and sensing a mobility and threshold voltage of a driving transistor for each of a plurality of pixels of the display panel based on a column driver sense control signal from the timing controller and supplying a mobility sensing value and a threshold voltage sensing value for each pixel to the timing controller in the sensing mode; and a memory in communication with the timing controller for storing the mobility sensing value and the threshold voltage sensing value, wherein, in the sensing mode, the timing controller calculates a threshold voltage prediction value of the driving transistor for each pixel using the mobility and the threshold voltage of the driving transistor for the pixel, and wherein, in the display mode, the panel driver drives each pixel based on the threshold voltage prediction value of the pixel, wherein the mobility and the threshold voltage of the driving transistor of each pixel are sensed at a shortened sensing time before a voltage saturation time at which a sensing voltage in accordance with a current flowing in the driving transistor is saturated, and wherein the timing controller calculates the threshold voltage prediction value for each pixel corresponding to the voltage saturation time on the basis of the threshold voltage sensing value of the driving transistor of the pixel, the mobility sensing value of the driving transistor of the pixel, and a capacitance of a reference line connected to a sensing node of the pixel.

It is to be understood that both the foregoing general description and the following detailed description of embodiments of the present invention are exemplary and explanatory and are intended to provide further explanation of the invention as claimed.

BRIEF DESCRIPTION OF THE DRAWINGS

The accompanying drawings, which are included to provide a further understanding of embodiments of the invention and are incorporated in and constitute a part of this application, illustrate embodiment(s) of the invention and together with the description serve to explain the principle of embodiments of the invention. In the drawings.

DETAILED DESCRIPTION OF THE INVENTION

Figure 1:
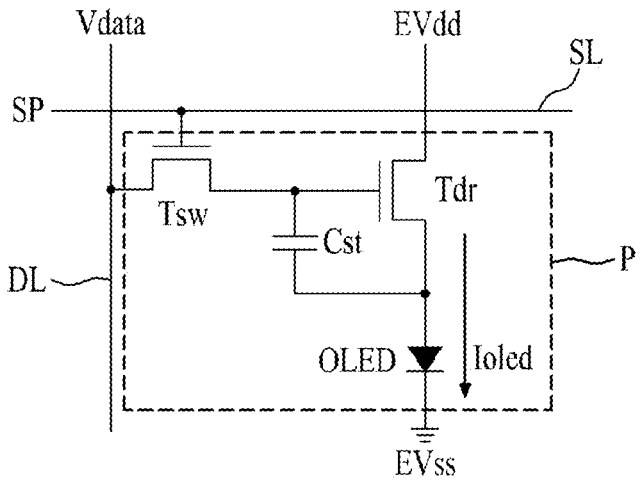
FIG. 1 Related Art
FIG. 1 is a circuit diagram illustrating a pixel structure of an organic light emitting display device according to the related art.

Reference will now be made in detail to the exemplary embodiments of the present invention, examples of which are illustrated in the accompanying drawings. Wherever possible, the same reference numbers will be used throughout the drawings to refer to the same or like parts.

Advantages and features of the present invention, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims.

A shape, a size, a ratio, an angle, and a number disclosed in the drawings for describing embodiments of the present invention are merely an example, and thus, the present invention is not limited to the illustrated details. Like reference numerals refer to like elements throughout. In the following description, when the detailed description of the relevant known function or configuration is determined to unnecessarily obscure the important point of the present invention, the detailed description will be omitted. In a case where 'comprise', 'have', and 'include' described in the present specification are used, another part may be added unless 'only~' is used. The terms of a singular form may include plural forms unless referred to the contrary. In construing an element, the element is construed as including an error region although there is no explicit description. In description of embodiments of the present invention, when a structure (for example, an electrode, a line, a wiring, a layer, or a contact) is described as being formed at an upper portion/lower portion of another structure or on/under the other structure, this description should be construed as including a case where the structures contact each other and moreover, a case where a third structure is disposed therebetween. In describing a time relationship, for example, when the temporal order is described as 'after~', 'subsequent~', 'next~', and 'before~', a case which is not continuous may be included unless 'just' or 'direct' is used. It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present invention.

Features of various embodiments of the present invention may be partially or overall coupled to or combined with each other, and may be variously inter-operated with each other and driven technically as those skilled in the art can sufficiently understand. The embodiments of the present invention may be carried out independently from each other, or may be carried out together in co-dependent relationship.

Hereinafter, an organic light emitting display device according to an embodiment of the present invention will be described with reference to the accompanying drawings.

Figure 2:
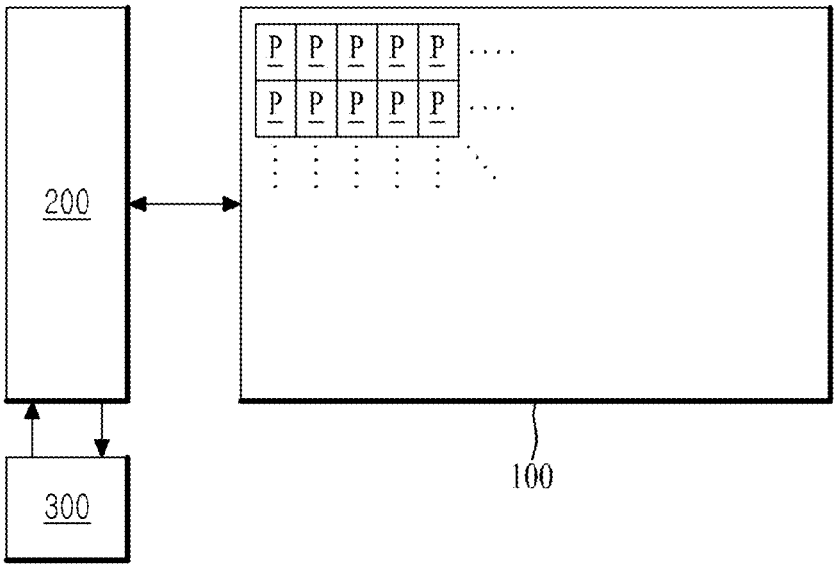
FIG. 2 illustrates an organic light emitting display device according to an exemplary embodiment of the present invention.

FIG. 2 illustrates an organic light emitting display device according to an exemplary embodiment of the present invention.

Referring to FIG. 2, the organic light emitting display device may include a display panel 100, a panel driver 200, and a memory 300.

The display panel 100 includes a plurality of pixels (P) that emit light by being driven by a data current based on a data voltage. Each pixel (P) may include a driving transistor which outputs the data current based on the data voltage, and drives an organic light emitting diode (OLED) to emit light.

The panel driver 200 drives the display panel 100 in accordance with a display mode or a sensing mode. Herein, the display mode includes driving of the display panel 100 for displaying a predetermined image by light emission of the organic light emitting diode (OLED) included in each pixel (P) in accordance with input data. Also, the sensing mode includes driving of the display panel 100 for sensing threshold voltage and/or mobility of the driving transistor for each pixel. For example, the sensing mode may be executed at the factory before product shipment of the organic light emitting display device, or may be executed at a preset time after the product shipment of the organic light emitting display device. The above preset period may be at a power-on of the organic light emitting display device, power-off of the organic light emitting display device, power-on after a preset driving time, power-off after a preset driving time, or the like.

For the sensing mode, the panel driver 200 drives the driving transistor for each pixel in a source follower mode, and senses a voltage at a sensing node through a reference line connected to the sensing node between the organic light emitting diode (OLED) and the driving transistor. In this case, the panel driver 200 generates a driving characteristic sensing value of the driving transistor for each pixel by sensing the voltage of the sensing node at a shortened sensing time before a voltage saturation at which the voltage of sensing node is saturated (or a predetermined time at which the voltage of the sensing node is raised), calculates a driving characteristic prediction value of the driving transistor corresponding to the voltage saturation on the basis of the driving characteristic sensing value, stores the calculated driving characteristic prediction value in the memory 300. For the display mode each pixel (P) is driven with correcting input data for each pixel on the basis of the driving characteristic prediction value of the driving transistor for each pixel stored in the memory 300.

Figure 3:
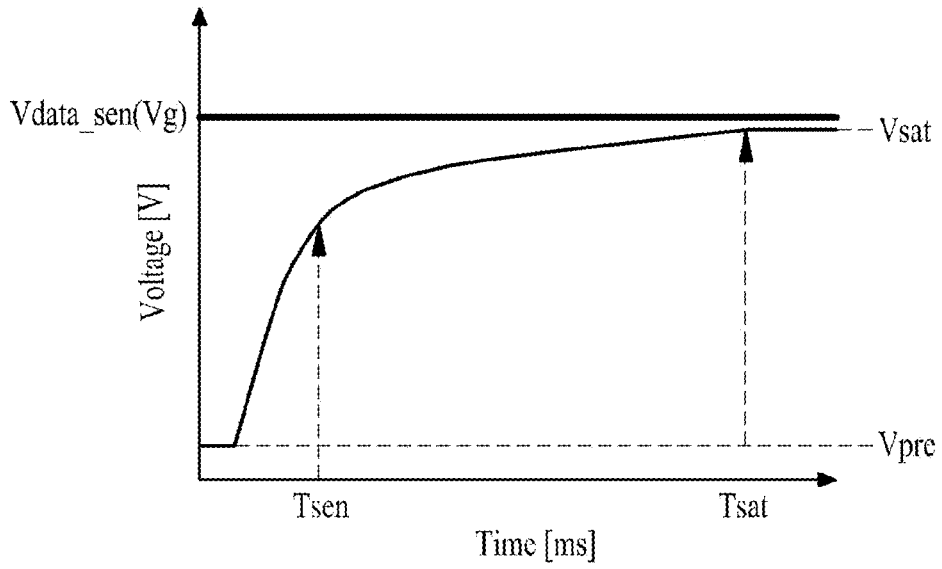
FIG. 3 is a graph explaining a sensing voltage waveform and a shortened sensing time in a sensing mode of the organic light emitting display device according to an exemplary embodiment of the present invention.

For example, in the sensing mode, as shown in FIG. 3, the panel driver 200 initializes the sensing node corresponding to a source electrode of the driving transistor with a pre-charging voltage (Vpre) having a constant voltage level, drives the driving transistor in the source follower mode by supplying a sensing data voltage (Vdata_sen) to a gate electrode of the driving transistor, and senses the voltage at the sensing node at the shortened sensing time (Tsen). The driver 200 then calculates a driving characteristic value of the driving transistor for each pixel, that is, a threshold voltage sensing value and a mobility sensing value. Then, the panel driver 200 calculates a threshold voltage prediction value (hereinafter, referred to as 'threshold voltage prediction value for each pixel, Vth') of the driving transistor for each pixel corresponding to the voltage saturation time (Tsat). Execution of a threshold voltage prediction function operation, as shown in the following Math Formula 1, is based on the threshold voltage sensing value of the driving transistor for each pixel sensed at the shortened sensing time (Tsen) (hereinafter, referred to as 'threshold voltage sensing value for each pixel'), the mobility sensing value of the driving transistor for each pixel ($\alpha$) sensed at the shortened sensing time (Tsen) (hereinafter, referred to as 'mobility sensing value for each pixel'), and a capacitance variable (Cref) of preset reference line, and then stores the calculated threshold voltage prediction value for each pixel in the memory 300.

That is, the panel driver 200 calculates a subtraction operation value (Vdata_sen−Vpre−Vth_sen) by subtracting the pre-charging voltage (Vpre) and the threshold voltage sensing value (Vth_sen) from the sensing data voltage (Vdata_sen); calculates a first division operation value (1/(Vdata_sen−Vpre−Vth_sen)) by dividing the constant '1' by the subtraction operation value (Vdata_sen−Vpre−Vth_sen); calculates a second division operation value ($\alpha$t/Cref) by dividing a predetermined value, which is obtained by multiplying the mobility sensing value (α) and the shortened sensing time (t), by the capacitance variable (Cref) of the reference line; calculates a third division operation value (1/((1/(Vdata_sen−Vpre−Vth_sen))+(αt/Cref))) by dividing the constant '1' by a predetermined value ((1/(Vdata_sen−Vpre−Vth_sen))+(αt/Cref)) which is obtained by adding the first division operation value (1/(Vdata_sen−Vpre−Vth_sen)) and the second division operation value (αt/Cref); and calculates the threshold voltage prediction value (Vth') by subtracting the third division operation value (1/((1/(Vdata_sen−Vpre−Vth_sen))+(αt/Cref))) from a differential voltage (Vgs(t)) between gate voltage (Vg) and source voltage (Vs) of the driving transistor. In this case, the capacitance variable (Cref) of the reference line is a value derived from results of prior experiments for a plurality of display panels 100, whereby the capacitance variable (Cref) of the reference line may be identically applied to all the display panels 100.

Additionally, in order to improve accuracy of the threshold voltage prediction value for each pixel, the panel driver 200 may calculate the finally-obtained threshold voltage prediction value for each pixel by repeating the following operation of the Math Formula 1 two or more times by using the threshold voltage prediction value (Vth') for each pixel, which is calculated by the following Math Formula 1, as the threshold voltage sensing value (Vth_sen) for each pixel.

Math Formula 1

$$Vth' = Vgs(t) - \frac{1}{\frac{1}{\text{Vdata_sen} - Vpre - \text{Vth_sen}} + \frac{\alpha}{Cref}t}$$

A process of deriving the threshold voltage prediction function of the above Math Formula 1 will be explained as follows.

First, the current flowing in the driving transistor of the pixel (P) may be calculated by the following Math Formula 2. In the sensing driving of the pixel (P), to sense the threshold voltage of the driving transistor, the current (Ids) flowing in the driving transistor is at a time when the driving transistor is turned-off.

Math Formula 2

$$Ids = \alpha(Vgs - Vth)^2$$

In the above Math Formula 2, 'α' is the mobility of the driving transistor, 'Vgs' is the differential voltage (Vg−Vs) between the gate voltage (Vg) and the source voltage (Vs) in the driving transistor, and 'Vth' is the threshold voltage of the driving transistor.

In the sensing driving of the pixel (P), the current flowing in the driving transistor in accordance with the time (t) will be expressed as the following Math Formula 3.

Math Formula 3

$$Ids(t) = \alpha(Vgs(t) - Vth)^2 = \alpha(Vdata - Vs(t) - Vth)^2$$

In the above Math Formula 3, 'Vdata' is the sensing data voltage applied to the gate electrode of the driving transistor for the sensing driving of the pixel (P), and 'Vs(t)' is the gate voltage of the driving transistor, wherein the sensing data voltage (Vdata(t)) is maintained at a constant voltage level without regard to the time (t).

In the sensing driving of the pixel (P), the current flowing in the reference line (or parasitic capacitance of the reference line, Cref) connected to the source electrode of the driving transistor driven in the source follower mode may be expressed as a differential value for the equation of charge of the capacitor and the time of the voltage.

Accordingly, when 'Vgs(t)−Vth' of the Math Formula 3 is referred to as 'V(t)', and 'V(t)' is substituted to the following Math Formula 4, which is applied to the capacitance (C) and the current (I) in the equation of charge (Q) of the capacitor, the current flowing in the reference line for the sensing driving of the pixel (P) may be expressed as the differential value (dv/dt) for the time (t) of the voltage (V), as shown in the following Math Formula 5.

Math Formula 4

$$Q = CV = It$$
$$\therefore \frac{dQ}{dt} = C\frac{dV}{dt} = I$$
$$\therefore \frac{dV}{dt} = \frac{I}{C}$$

Math Formula 5

$$Ids(t) = \alpha(Vgs(t) - Vth)^2$$
$$\therefore V(t) = Vgs(t) - Vth$$
$$Ids(t) = \alpha V(t)^2$$
$$\therefore \frac{dV(t)}{dt} = \frac{Ids(t)}{Cref} = \frac{\alpha}{Cref}V(t)^2$$

Through the above Math Formulas 2 to 5, the voltage charged in the reference line may be numerically or formulaically expressed in terms of the current flowing in the driving transistor of the pixel (P). That is, after the case having the sensing time (t) of 0 (zero) is calculated in the differential equation of the above Math Formula 5, the constant 'A' may be calculated by the following Math Formula 6.

Math Formula 6

$$\frac{dV(t)}{dt} = \frac{\alpha}{Cref}V(t)^2$$
$$\therefore V(t) = \frac{1}{A + \frac{\alpha}{Cref}t}$$
$$A = \frac{1}{V(0)} = \frac{1}{Vgs(0) - Vth} = \frac{1}{Vdata - Vpre - Vth}$$

The calculated constant 'A' is results from Math Formula 6 relating the function V(t), and the function V(t) is applied to the Math Formula 5 relating the function V(t), whereby the Math Formula 7 relating 'Vth' may be derived as follows.

Math Formula 7

$$V(t) = Vgs(t) - Vth$$
$$\frac{1}{\frac{1}{Vdata - Vpre - Vth} + \frac{\alpha}{Cref}t} = Vgs(t) - Vth$$
$$Vth = Vgs(t) - \frac{1}{\frac{1}{Vdata - Vpre - Vth} + \frac{\alpha}{Cref}t}$$

In the above Math Formula 7, 'Vth' of the left side denotes the threshold voltage prediction value of the driving transistor, and 'Vth' of the right side denotes the threshold voltage sensing value (Vth_sen) of the driving transistor.

The panel driver 200 according to another aspect of the embodiment may calculate the threshold voltage prediction value (Vth') for each pixel at the voltage saturation time (Tsat) by executing the threshold voltage prediction function operation as shown in the following Math Formula 8 based on the mobility sensing value (α) and threshold voltage sensing value (Vth_sen) for each pixel sensed at the shortened sensing time (Tsen), the capacitance variable (Cref) of the preset reference line and a mobility offset value.

Math Formula 8

$$Vth' = Vgs(t) - \frac{1}{\frac{1}{\text{Vdata_sen} - Vpre - \text{Vth_sen}} + \frac{\alpha}{Cref}t} + n$$

$$\therefore n = c\alpha + d$$

Herein, mobility offset coefficients (c, d) are predetermined by prior-experiments based on the mobility sensing value (α) for each pixel sensed at the shortened sensing time (Tsen), which will be described as follows.

First, the pixels (P) having the same mobility sensing value (α) are selected from the display panel 100, and the selected pixels (P) are counted by each mobility sensing value and are then plotted with the number of pixels for each mobility sensing value.

Figure 4:
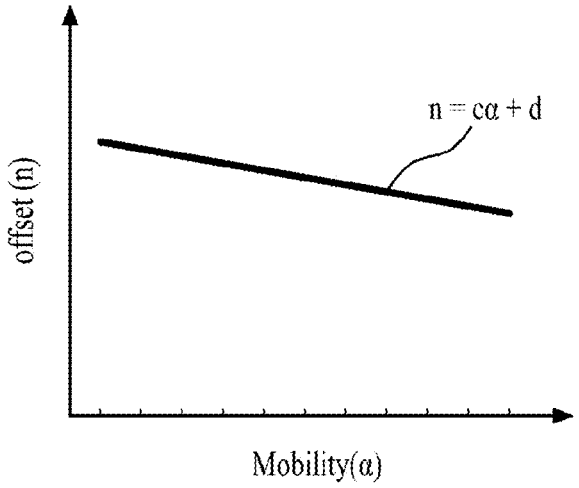
FIG. 4 is a graph explaining a mobility offset function in a sensing mode of the organic light emitting display device according to an exemplary embodiment of the present invention.

Then, the coordinates of the number of pixels for the mobility sensing values are linearly interpolated, as shown in FIG. 4, to determine a mobility offset function (n) which includes a variable using the mobility sensing value (α) for each pixel, a linear term coefficient using the constant 'c', and a zero-term coefficient using the constant 'd'. As the mobility offset function (n) is identically applied to all display panels 100, it is possible to accurately calculate the threshold voltage prediction value for each pixel by providing the mobility offset value (n) corresponding to the mobility sensing value of the driving transistor.

Thereafter, the linear term coefficient (c) and the zero-order term coefficient (d) are respectively determined as the mobility offset coefficients (c, d) from the calculated mobility offset function (n), and then the mobility offset coefficients (c, d) are stored in the memory 300.

Accordingly, the panel driver 200 may calculate the threshold voltage prediction value (Vth') for each pixel by retrieving the mobility offset coefficients (c, d) stored in the memory 300, calculating the mobility offset value (n) through the operation of the mobility offset function (n), subtracting the third division operation value (1/((1/(Vdata_sen−Vpre−Vth_sen))+(αt/Cref))) from the differential voltage (Vgs(t)) between the gate voltage (Vg) of the driving transistor and the source voltage (Vs) of the driving transistor, and adding the subtraction operation value (Vgs(t)−(1/((1/(Vdata_sen−Vpre−Vth_sen))+(αt/Cref)))) and the mobility offset value (n). In addition, the panel driver 200 may calculate the threshold voltage prediction value for each pixel by repeating the operation of the above Math Formula 8 two or more times by using the threshold voltage prediction value (Vth') for each pixel, which is calculated by the above Math Formula 8, as the threshold voltage sensing value (Vth_sen) for each pixel, to improve accuracy of the threshold voltage prediction value for each pixel.

Eventually, it is possible to calculate the threshold voltage prediction value for each pixel corresponding to the voltage saturation time (Tsat) by executing the threshold voltage prediction function operation through the above Math Formula 1 based on the mobility sensing value (α) and threshold voltage sensing value (Vth_sen) for each pixel sensed at the shortened sensing time (Tsen) and the capacitance variable (Cref) of the preset reference line, and the above Math Formula 8 based on the mobility sensing value (α) and threshold voltage sensing value (Vth_sen) for each pixel sensed at the shortened sensing time (Tsen), the capacitance variable (Cref) of the preset reference line, and the mobility offset coefficients (c, d).

In a typical sensing mode, after initialization of the sensing voltage, the sensing voltage is saturated after the sufficient time lapse by the influence of the capacitance, whereby it should be delayed until the driving transistor is turned-off, thereby causing an increase of sensing time. However, in case of the present invention, the mobility sensing value for each pixel and the threshold voltage sensing value for each pixel are sensed at the shortened sensing time (Tsen) preset before the voltage saturation time (Tsat) at which the sensing voltage of the sensing node is saturated. The threshold voltage prediction value for each pixel corresponding to the voltage saturation time (Tsat) is calculated by the function operation using the mobility sensing value for each pixel and the threshold voltage sensing value for each pixel, to thereby shorten the sensing time of the sensing mode.

In the display mode, the panel driver calculates a characteristic compensation value for each pixel so as to compensate for the change of threshold voltage in the driving transistor for each pixel on the basis of a deviation between the initial threshold voltage prediction value of the driving transistor for each pixel stored in the memory 300 and the threshold voltage prediction value (Vth') for each pixel calculated by the prior sensing mode stored in the memory 300, corrects input data of the corresponding pixel (P) in accordance with the calculated characteristic compensation value for each pixel, and drives the corresponding pixel (P) on the basis of the corrected input data.

The variables needed for the threshold voltage prediction function operation are stored in the memory 300. For example, the variables may be the sensing data voltage (Vdata_sen) applied to the gate electrode of the driving transistor for the sensing mode, the sensing pre-charging voltage (Vpre) applied to the source electrode of the driving transistor in the sensing mode, the capacitance value (Cref) for the reference line, and the shortened sensing time (t).

Figure 5:
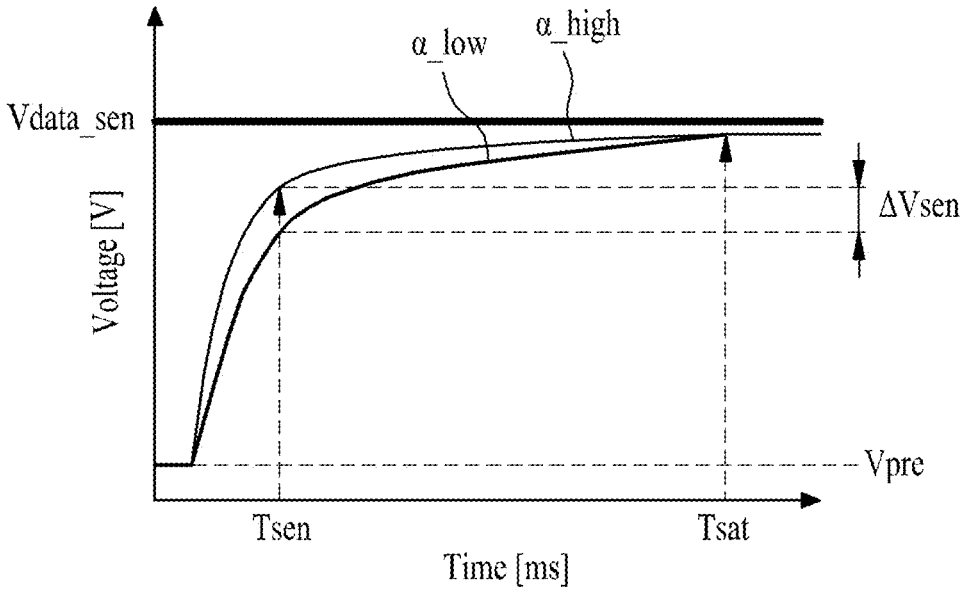
FIG. 5 is a graph explaining a deviation of sensing voltage occurring at a shortened sensing time.

Accordingly, as illustrated in FIG. 5, the organic light emitting display device according to an embodiment is capable of shortening the sensing time of the driving transistor for each pixel by predicting the threshold voltage of the driving transistor for each pixel corresponding to the voltage saturation time (Tsat) on the basis of the mobility sensing value (α) and threshold voltage sensing value (Vth_sen) sensed at the shortened sensing time (Tsen). Furthermore, the mobility sensing value (α) for each pixel and the mobility offset coefficients (c, d) are reflected in the threshold voltage prediction value for each pixel so that it is possible to compensate for the sensing voltage deviation (ΔVsen) between a driving transistor with a low mobility (α_low) and a driving transistor with a high mobility (α_high) caused by the shortened sensing time, to thereby improve accuracy of the threshold voltage prediction value for each pixel.

Hereinafter, a structure of the organic light emitting display device including the panel driver according to an exemplary embodiment will be described with reference to FIGS. 6 to 10.

Figure 6:
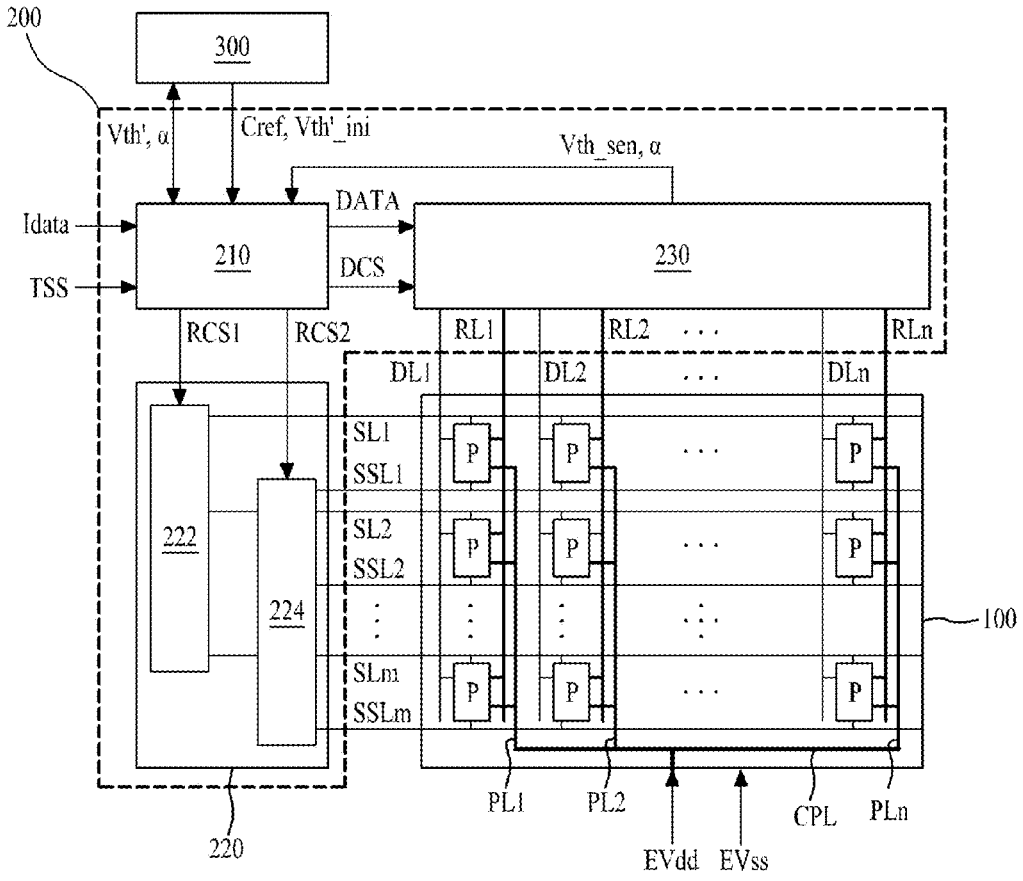
FIG. 6 illustrates a structure of the organic light emitting display device according to an exemplary embodiment of the present invention.
Figure 7:
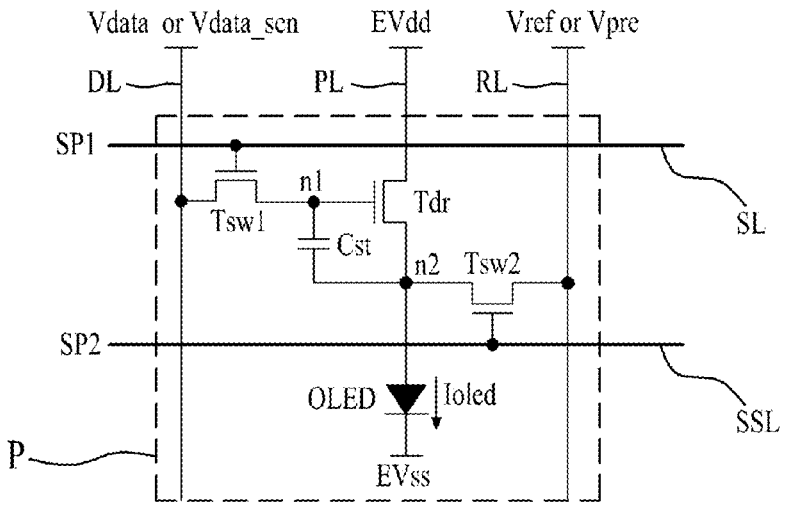
FIG. 7 is a circuit diagram illustrating a structure of a pixel shown in FIG. 6.

FIG. 6 illustrates a structure of an organic light emitting display device according to an embodiment, and FIG. 7 is a circuit diagram of the pixel shown in FIG. 6.

Referring to FIGS. 6 and 7, as described above, the organic light emitting display device according to one embodiment may include the display panel 100, the panel driver 200, and the memory 300.

On the display panel 100, there are first to m-th ('m' is an integer) scan control lines (SL1 to SLm), first to m-th sensing control lines (SSL1 to SSLm), first to n-th ('n' is an integer which is larger than 'm') data lines (DL1 to DLn), first to n-th reference lines (RL1 to RLn), first to n-th driving power lines (PL1 to PLn), a cathode electrode (not shown), and the plurality of pixels (P).

The first to m-th scan control lines (SL1 to SLm) are at intervals in a first direction of the display panel 100, that is, a horizontal direction of the display panel 100.

The first to m-th sensing control lines (SSL1 to SSLm), which are at intervals, are in parallel with the scan control lines (SL1 to SLm).

The first to n-th data lines (DL1 to DLn) are at intervals in a second direction of the display panel 100, that is, a vertical direction of the display panel 100, wherein the first to n-th data lines (DL1 to DLn) cross the scan control lines (SL1 to SLm) and the sensing control lines (SSL1 to SSLm).

The first to n-th reference lines (RL1 to RLn) are in parallel with the data lines (DL1 to DLn).

The first to n-th driving power lines (PL1 to PLn) may be in parallel with the data lines (DL1 to DLn). The first to n-th driving power lines (PL1 to PLn) may all be connected with a driving power common line (CPL) in an upper and/or lower non-display area of the display panel 100. Selectively, the first to n-th driving power lines (PL1 to PLn) may be at intervals in parallel with the scan control lines (SL1 to SLm). In this case, the driving power common line (CPL) may be in a left and/or right non-display area of the display panel 100.

The cathode electrode may cover an entire surface of a display area defined on the display panel 100, or may be in a line shape parallel with the data lines (DL1 to DLn) or scan control lines (SL1 to SLm).

The plurality of pixels (P) are formed in every pixel region defined by the respective crossing of the first to m-th scan control lines (SL1 to SLm) and the first to n-th data lines (DL1 to DLn). In this case, each of the plurality of pixels (P) may be one of red, green, blue, and white sub-pixels. A unit pixel for displaying an image may include red, green, blue, and white pixels close to one another, or may include red, green, and blue pixels close to one another.

Each of the plurality of pixels (P) may include a first switching transistor (Tsw1), a second switching transistor (Tsw2), a driving transistor (Tdr), a capacitor (Cst), and an organic light emitting diode (OLED). In this case, the transistors (Tsw1, Tsw2, Tdr) may be thin-film transistors (TFT), for example, a-Si TFT, poly-Si TFT, oxide TFT, or organic TFT.

As the first switching transistor (Tsw1) is switched by a first scan pulse (SP1), the first switching transistor (Tsw1) outputs a data voltage (Vdata or Vdata_sen) supplied to the data line (DL). To this end, the first switching transistor (Tsw1) may include a gate electrode connected to the closest scan control line (SL), a first electrode connected to the closest data line (DL), and a second electrode connected to a first node (n1) corresponding to a gate electrode of the driving transistor (Tdr). The first and second electrodes of the first switching transistor (Tsw1) may be a source electrode or drain electrode in accordance with the current direction.

As the second switching transistor (Tsw2) is switched by a second scan pulse (SP2), the second switching transistor (Tsw2) supplies a voltage (Vref or Vpre), which is supplied to the reference line (RL), to a second node (n2, or sensing node) corresponding to a source electrode of the driving transistor (Tdr). To this end, the second switching transistor (Tsw2) may include a gate electrode connected to the closest sensing control line (SSL), a first electrode connected to the closest reference line (RL), and a second electrode connected to the second node (n2). In this case, the first and second electrodes of the second switching transistor (Tsw2) may be a source electrode or drain electrode in accordance with the current direction.

The capacitor (Cst) may include a first electrode, a second electrode, and a dielectric layer between the first and second electrodes. Herein, the first electrode of the capacitor (Cst) is connected to the first node (n1), and the second electrode of the capacitor (Cst) is connected to the second node (n2). After the capacitor (Cst) is charged with a differential voltage between a voltage supplied to the first node (n1) and a voltage supplied to the second node (n2) in accordance with the switching of the first and second switching transistors (Tsw1, Tsw2), the driving transistor (Tdr) is switched by the charged voltage.

As the driving transistor (Tdr) is turned-on by the voltage of the capacitor (Cst), it is possible to control an amount of current flowing from the driving power line (PL) to the organic light emitting diode (OLED). To this end, the driving transistor (Tdr) may include a gate electrode connected with the first node (n1), a source electrode connected with the second node (n2), and a drain electrode connected with the driving power line (PL).

A data current (Ioled) supplied from the driving transistor (Tdr) to the organic light emitting diode (OLED) causes the OLED to emit monochromatic light with a luminance corresponding to the data current (Ioled). To this end, the organic light emitting diode (OLED) may include an anode electrode connected to the second node (n2), and an organic layer (not shown) between the anode electrode and the cathode electrode. The organic layer may be in a structure of a hole transport layer/organic light emitting layer/electron transport layer, or hole injection layer/hole transport layer/organic light emitting layer/electron transport layer/electron injection layer. Furthermore, the organic layer may include a functional layer for improving light emission efficiency and/or lifespan of the organic light emitting layer.

The panel driver 200 may include a timing controller 210, a row driver 220, and a column driver 230.

The timing controller 210 may drive the row driver 220 and the column driver 230 in accordance with the sensing mode for sensing the mobility and the threshold voltage of the driving transistor (Tdr) for each pixel at a preset time period. In the sensing mode, the timing controller 210 may generate a data control signal (DCS), sensing pixel data (DATA) for each pixel, and first and second row control signals (RCS1, RCS2) to drive the driving transistor (Tdr) of each pixel (P) in the source follower mode. Then, the timing controller 210 calculates the threshold voltage prediction value (Vth') for each pixel corresponding to the voltage saturation time (Tsat) by executing the threshold voltage prediction function operation through the above Math Formula 1 based on the mobility sensing value ($\alpha$) and the threshold voltage sensing value (Vth_sen) for each pixel provided from the column driver 230.

The timing controller 210 may drive the row driver 220 and the column driver 230 in accordance with the display mode for displaying an image on the display panel 110. For the display mode, the timing controller 210 generates correction data (DATA) for each pixel by generating the characteristic compensation value for each pixel to compensate for the change of threshold voltage in the driving transistor for each pixel on the basis of a deviation between the initial threshold voltage prediction value (Vth'_ini) of the driving transistor for each pixel stored in the memory 300 and the threshold voltage prediction value (Vth') for each pixel calculated by the prior sensing mode stored in the memory 300, and correcting the input data (Idata) for each pixel in accordance with the calculated characteristic compensation value for each pixel, and then provides the generated correction data (DATA) for each pixel to the column driver 230. The timing controller 210 may generate a data control signal (DCS) and first and second row control signals (RCS1, RCS2) to make the organic light emitting diode (OLED) for each pixel (P) emit light in accordance with the display mode, and controls the driving of the row driver 220 and the driving of the column driver 230 in accordance with the generated data control signal (DCS) and first and second row control signals (RCS1, RCS2).

The row driver 220 sequentially generates a first scan pulse (SP1) based on the first row control signal (RCS1) supplied from the timing controller 210, and sequentially supplies the first scan pulse (SP1) to the first to m-th scan control lines (SL1 to SLm). Also, the row driver 220 sequentially generates a second scan pulse (SP2) based on the second row control signal (RCS2) supplied from the timing controller 210, and sequentially supplies the second scan pulse (SP2) to the first to m-th sensing control lines (SSL1 to SSLm). In this case, the row control signals (RCS1, RCS2) may include a start signal and a plurality of clock signals. The row driver 220 may include a scan line driver 222, and a sensing line driver 224.

The scan line driver 222 may be connected to one side and/or the other side of each of the first to m-th scan control lines (SL1 to SLm). The scan line driver 222 generates a first scan signal sequentially shifted based on the first row control signal (RCS1), and level-shifts the first scan signal to the first scan pulse (SP1) by the use of gate-on voltage and gate-off voltage, and sequentially supplies the level-shifted signal to the first to m-th scan control lines (SL1 to SLm).

The sensing line driver 224 may be connected with one side and/or the other side of each of the first to m-th sensing control lines (SSL1 to SSLm). The sensing line driver 224 generates a second scan signal sequentially shifted based on the second row control signal (RCS2), and level-shifts the second scan signal to the second scan pulse (SP2) by the use of gate-on voltage and gate-off voltage, and sequentially supplies the level-shifted signal to the first to m-th sensing control lines (SSL1 to SSLm).

The column driver 230 is connected to the first to n-th data lines (DL1 to DLn), wherein the column driver 230 is driven in the display mode and the sensing mode in accordance with the mode control of the timing controller 210.

Figure 8:
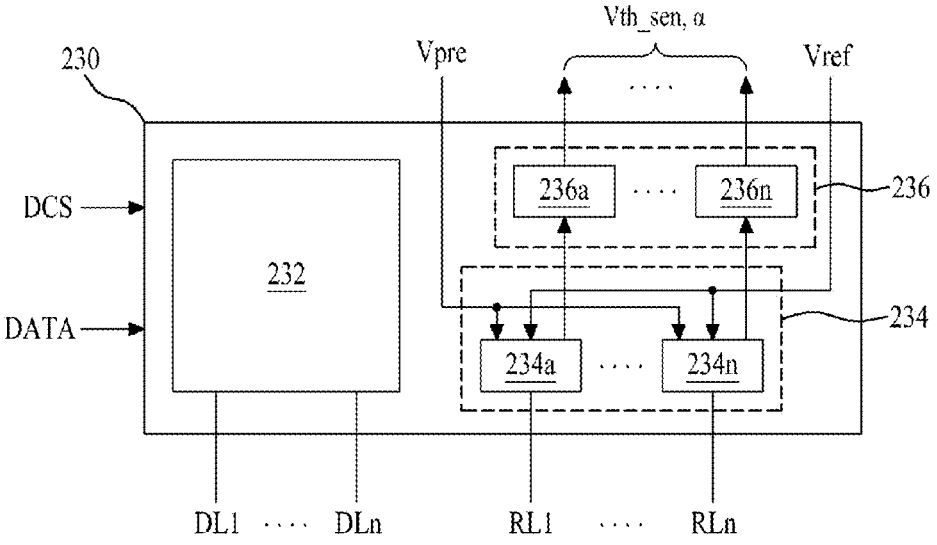
FIG. 8 is a block diagram illustrating a column driver of FIG. 6.

In the display mode, the column driver 230 supplies the data voltage (Vdata) to the corresponding data line (DL1 to DLn) for each horizontal line on the basis of data control signal (DCS) and correction data (DATA) for each pixel supplied from the timing controller 210, and simultaneously supplies the reference voltage (Vref) to the corresponding reference line (RL1 to RLn). In the sensing mode, the column driver 230 generates the mobility sensing value (α) and the threshold voltage sensing value (Vth_sen) for each pixel by sensing the mobility and threshold voltage of the driving transistor (Tdr) for each pixel on the basis of data control signal (DCS) and sensing pixel data (DATA) supplied from the timing controller 210, and provides the generated mobility sensing value (α) and the threshold voltage sensing value (Vth_sen) for each pixel to the timing controller 210. To this end, the column driver 230 may include a data driving part 232, a switching part 234, and a sensing part 236, as shown in FIG. 8.

In accordance with the display mode, the data driving part 232 converts the correction data (DATA) for each pixel supplied from the timing controller 210 into the data voltage (Vdata) in response to the data control signal (DCS) supplied from the timing controller 210, and supplies the data voltage (Vdata) to the first to n-th data lines (DL1 to DLn). In accordance with the sensing mode, the data driving part 232 converts the sensing pixel data (DATA), which is supplied from the timing controller 210, into the sensing data voltage (Vdata_Sen) in response to the data control signal (DCS) supplied from the timing controller 210, and supplies the sensing data voltage (Vdata_sen) to the first to n-th data lines (DL1 to DLn).

The switching part 234 supplies the externally-provided reference voltage (Vref) to the first to n-th reference lines (RL1 to RLn) in response to a pre-charging control signal supplied from the timing controller 210 in the display mode. The switching part 234 initializes the first to n-th reference lines (RL1 to RLn) with the pre-charging voltage (Vpre) by supplying the externally-provided pre-charging voltage (Vpre) to the first to n-th reference lines (RL1 to RLn) in response to the pre-charging control signal supplied from the timing controller 210 in accordance with the sensing mode, and then connects the first to n-th reference lines (RL1 to RLn) to the sensing part 236 in response to a sampling control signal supplied from the timing controller 210. To this end, the switching part 234 may include first to n-th selectors 234*a* to 234*n* respectively connected with the first to n-th reference lines (RL1 to RLn) and the sensing part 236, wherein the selectors 234*a* to 234*n* may be multiplexers.

As the sensing part 236 is connected with the first to n-th reference lines (RL1 to RLn) through the switching part 234 in accordance with the sensing mode, the sensing part 236 senses the voltage of each of the first to n-th reference lines (RL1 to RLn), generates the mobility sensing value (α) and threshold voltage sensing value (Vth_sen) corresponding to the sensed voltage, and provides the generated mobility sensing value (α) and threshold voltage sensing value (Vth_sen) to the timing controller 210. To this end, the sensing part 236 may include first to n-th analog-to-digital converters 236*a* to 236*n* connected with the first to n-th reference lines (RL1 to RLn) through the switching part 234.

Figure 9:
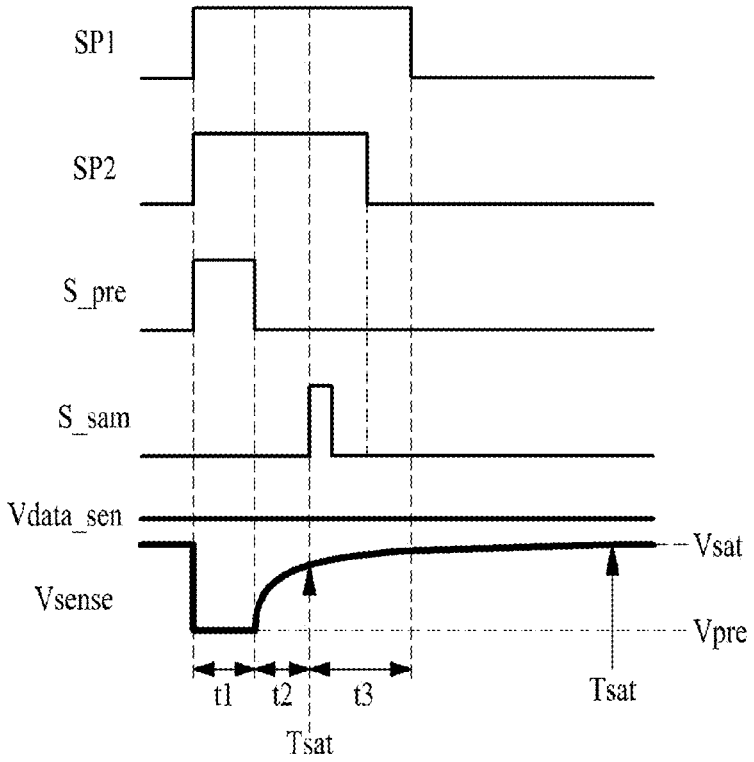
FIG. 9 is a driving waveform diagram of a sensing mode in the organic light emitting display device according to an exemplary embodiment of the present invention.

FIG. 9 is a driving waveform diagram of the sensing mode in the organic light emitting display device.

The sensing mode of the organic light emitting display device in connection with FIGS. 6 to 8, will be described with reference to FIG. 9.

In the sensing mode, the pixel (P) may be driven in first, second, and third time periods (t1, t2, t3).

In the first period (t1), the first switching transistor (Tsw1) is turned-on by the first scan pulse (SP1) of the gate-on voltage, whereby the sensing data voltage (Vdata_sen) supplied to the data line (DL) is supplied to the gate electrode of the driving transistor (Tdr), and the pre-charging voltage (Vpre) is supplied to the reference line (RL) by the switching of the switching part 234 in accordance with the pre-charging control signal (S_pre). At the same time, the second switching transistor (Tsw2) is turned-on by the second scan pulse (SP2) of the gate-on voltage, whereby the pre-charging voltage (Vpre) is supplied to the sensing node (n2) via the reference line (RL) and the second switching transistor (Tsw2). In this case, the sensing data voltage (Vdata_sen) has a level of a target voltage which is preset to sense the threshold voltage of the driving transistor (Tdr). Accordingly, for the first period (t1), the reference line (RL) and the sensing node (n2) corresponding to the source electrode of the driving transistor (Tdr) are initialized with the pre-charging voltage (Vpre).

In the second period (t2), the first switching transistor (Tsw1) is maintained in the turning-on state by the first scan pulse (SP1) of the gate-on voltage, whereby the gate voltage of the driving transistor (Tdr) is fixed as the sensing data voltage (Vdata_sen). In this case, the reference line (RL) is in the floating state by the switching part 234 of the column driver 230. Accordingly, the driving transistor (Tdr) is driven in the saturation driving mode by the sensing data voltage (Vdata_sen) supplied to the gate electrode, whereby the reference line (RL) of the floating state is slowly charged with the voltage corresponding to the current flowing in the driving transistor (Tdr) by the influence of the capacitance.

In the third period (t3), each of the first and second switching transistors (Tsw1, Tsw2) is maintained in the turning-on state, and the reference line (RL) is connected to the sensing part 236 through the switching part 234 of the column driver 230 by the sampling control signal (S_sam) generated at the shortened sensing time (Tsat) preset before the voltage saturation time (Tsat) at which the voltage of the sensing node (n2) is saturated. Accordingly, the sensing part 236 senses the voltage (Vsense) of the reference line (RL), generates the threshold voltage sensing value (Vth_sen) of the driving transistor (Tdr) by the analog-to-digital conversion of the sensed voltage (Vsense), and provides the generated threshold voltage sensing value (Vth_sen) to the timing controller 210. The timing controller 210 stores the threshold voltage sensing value (Vth_sen) for each pixel, provided from the column driver 230, in an internal memory (or memory 300).

After completion of the sensing of the threshold voltage sensing value (Vth_sen) for each pixel through the first, second, and third periods (t1, t2, t3) of the sensing mode, the timing controller 210 controls the driving of each of the row driver 220 and the column driver 230 so as to re-execute the sensing mode for sensing the mobility of the driving transistor (Tdr) for each pixel. In this case, when the timing controller 210 re-executes the aforementioned sensing mode, the driving of each of the row driver 220 and the column driver 230 is controlled in such a manner that the first switching transistor (Tsw1) of each pixel (P) is turned-on only for the first period (t1) and the sensing data voltage (Vdata_sen) is supplied only for the first period (t1). For the re-execution of the sensing mode, the first switching transistor (Tsw1) is turned-off for the second period (t2), whereby the gate-source voltage of the driving transistor (Tdr) is raised so that the gate-source voltage of the driving transistor (Tdr) is maintained by the voltage of the capacitor (Cst), and the floating reference line (RL) is charged with the voltage corresponding to the mobility sensing value ($\alpha$) of the driving transistor (Tdr), that is, the voltage corresponding to the current flowing in the driving transistor (Tdr). For the re-execution of the sensing mode, the sensing part 236 of the column driver 230 generates the mobility sensing value ($\alpha$) for each pixel by sensing the voltage (Vsense) of the reference line (RL) and executes the analog-to-digital conversion of the sensed voltage (Vsense), and provides the generated mobility sensing value ($\alpha$) for each pixel to the timing controller 210. The timing controller 210 stores the mobility sensing value ($\alpha$) for each pixel, provided from the column driver 230, in the internal memory (or memory 300).

After completion of the sensing of the threshold voltage sensing value (Vth_sen) for each pixel through the sensing mode, the timing controller 210 calculates the threshold voltage prediction value (Vth') corresponding to the voltage saturation time (Tsat) by executing the threshold voltage prediction function operation in accordance with the above Math Formula 8 based on the mobility sensing value ($\alpha$) and threshold voltage sensing value (Vth_sen) for each pixel sensed at the shortened sensing time (Tsen), the capacitance variable (Cref) of the preset reference line and the mobility offset coefficients (c, d), or above Math Formula 1 based on the mobility sensing value ($\alpha$) and threshold voltage sensing value (Vth_sen) for each pixel sensed at the shortened sensing time (Tsen) stored in the internal memory (or memory 300) and the capacitance variable (Cref) of the preset reference line, and then stores the calculated threshold voltage prediction value (Vth') in the memory 300.

Figure 10:
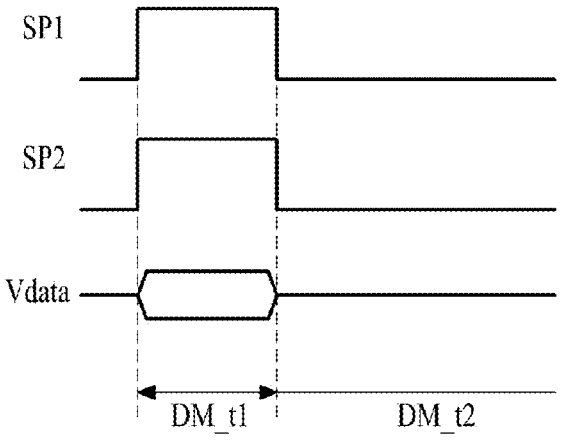
FIG. 10 is a driving waveform diagram of a display mode in the organic light emitting display device according to an exemplary embodiment of the present invention.

FIG. 10 is a driving waveform diagram of the display mode in the organic light emitting display device.

The display mode of the organic light emitting display device will be described with reference to FIG. 10, in connection with FIGS. 6 to 8.

In the display mode, the pixel (P) may be driven during an addressing period (DM_t1) and a light emission period (DM_t2).

First, in the display mode, the timing controller 210 calculates the characteristic compensation value for each pixel to compensate for the change in the threshold voltage of the driving transistor for each pixel on the basis of a deviation between the initial threshold voltage prediction value of the driving transistor for each pixel stored in the memory 300 and the threshold voltage prediction value (Vth') for each pixel calculated by the prior sensing mode stored in the memory 300, and generates the correction data (DATA) for each pixel by correcting the input data (Idata) for each pixel based on the calculated characteristic compensation value for each pixel. Accordingly, the column driver 230 converts the correction data (DATA) for each pixel, provided from the timing controller 210, into the data voltage (Vdata), and then supplies the data voltage (Vdata) to the data line (DL).

In the addressing period (DM_t1), the first switching transistor (Tsw1) is turned-on by the first scan pulse (SP1) of the gate-on voltage, whereby the data voltage (Vdata) supplied to the data line (DL) is supplied to the gate electrode of the driving transistor (Tdr), and the reference voltage (Vref) is supplied to the reference line (RL) by the switching of the switching part 234 in accordance with the pre-charging control signal. At the same time, the second switching transistor (Tsw2) is turned-on by the second scan pulse (SP2) of the gate-on voltage, whereby the reference voltage (Vref) is supplied to the source electrode of the driving transistor (Tdr), that is, the second node (n2) via the reference line (RL) and the second switching transistor (Tsw2). Accordingly, the capacitor (Cst) connected with the first node (n1) and the second node (n2) is charged with the differential voltage (Vdata−Vref) between the data voltage (Vdata) and the reference voltage (Vref).

In the light emission period (DM_t2), the first switching transistor (Tsw1) is turned-off by the first scan pulse (SP1) of the gate-off voltage, and the second switching transistor (Tsw2) is turned-off by the second scan pulse (SP2) of the gate-off voltage, whereby the driving transistor (Tdr) is turned-on by the voltage (Vdata−Vref) stored in the capacitor (Cst). Accordingly, the turned-on driving transistor (Tdr) supplies the data current (Ioled), which is determined by the differential voltage (Vdata−Vref) between the data voltage (Vdata) and the reference voltage (Vref), to the organic light emitting diode (OLED), whereby the organic light emitting diode (OLED) emits light in proportion to the data current (Ioled) flowing from the driving power line (PL) to the cathode electrode. That is, when the first and second switching transistors (Tsw1, Tsw2) are turned-off for the light emission period (DM_t2), the current flows in the driving transistor (Tdr), and the organic light emitting diode (OLED) emits light in proportion to the current flowing in the driving transistor (Tdr), whereby the voltage of the second node (n2) is raised in accordance with the light emission of the organic light emitting diode (OLED). Also, the voltage of the first node (n1) is raised by the increased voltage of the second node (n2) through the capacitor (Cst), whereby the gate-source voltage (Vgs) of the driving transistor (Tdr) is continuously maintained by the voltage of the capacitor (Cst), and the light emission of the organic light emitting diode (OLED) is maintained until the addressing period (DM_t1) of the next frame.

Figure 11A:
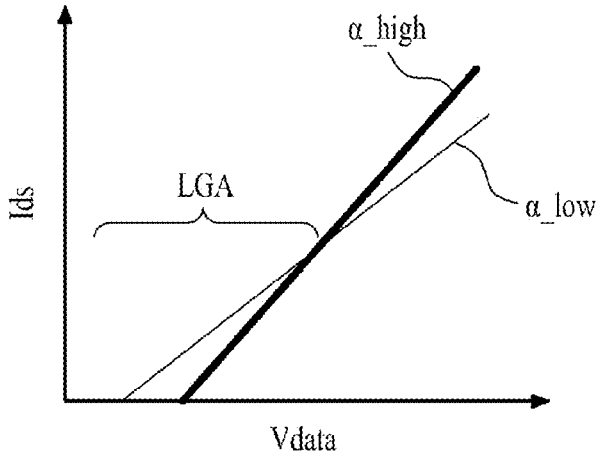
FIG. 11A and FIG. 11B is a graph illustrating a current flowing in a driving transistor for a data voltage in an exemplary embodiment of the present invention and a comparative example.
Figure 11B:
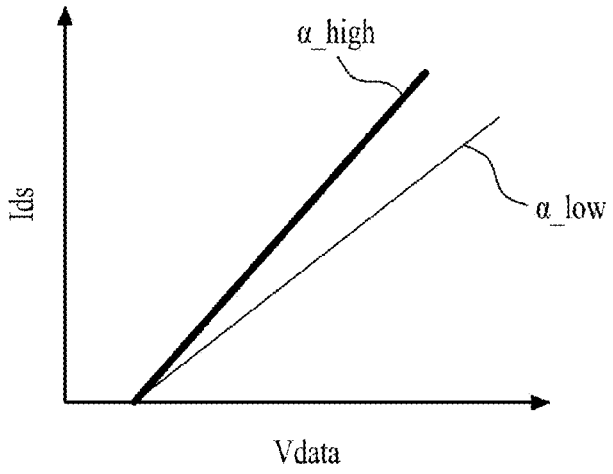

FIG. 11A and FIG. 11B are graphs illustrating the current flowing in the driving transistor for the data voltage in the present invention and a comparative example, wherein FIG. 11A is a graph of the comparative example in which the current flowing in the driving transistor for the data voltage is measured by the shortened sensing method and the threshold voltage compensation, and FIG. 11B is a graph of the present invention in which the current flowing in the driving transistor for the data voltage is measured by the shortened sensing method and the threshold voltage prediction compensation function.

First, as shown in FIG. 11A, in case of the comparative example, a grayscale inversion occurs in a low-grayscale area (LGA). That is, the deviation of the sensing voltage is generated by the mobility deviation (α_high, α_low) of the driving transistor for each pixel occurring at the shortened sensing time, and the threshold voltage is compensated based on the deviation of the sensing voltage, whereby the grayscale inversion occurs in the low-grayscale area (LGA).

As shown in FIG. 11B, in case of the present invention, the grayscale inversion does not occur in the low-grayscale area (LGA). That is, the shortened sensing method and the threshold voltage prediction compensation function including the mobility sensing value (α) for each pixel are applied so that the grayscale inversion does not occur in the low-grayscale area (LGA).

Figure 12A:
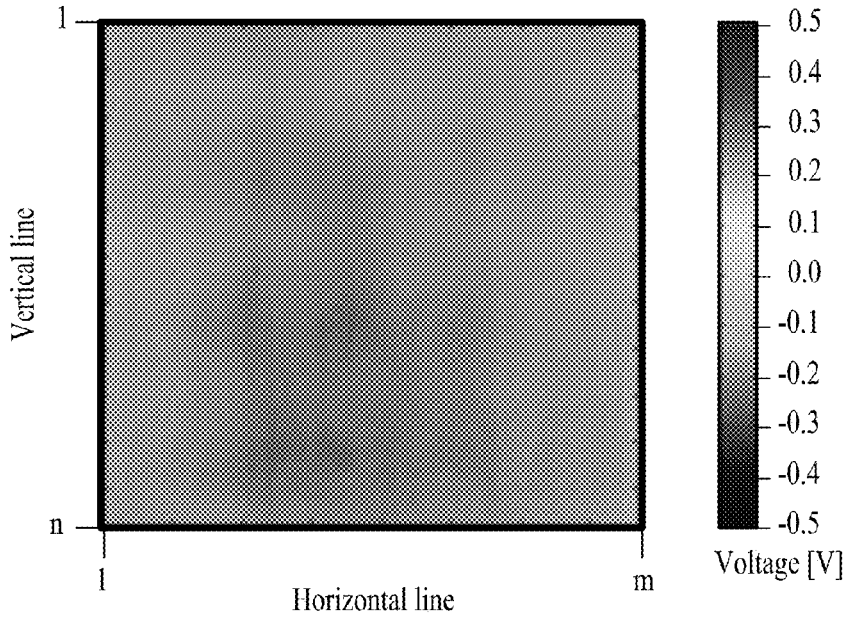
FIG. 12A and FIG. 12B show a deviation for each pixel between a threshold voltage sensed at a shortened sensing time and a threshold voltage sensed at a voltage saturation time in an exemplary embodiment of the present invention and a comparative example.
Figure 12B:
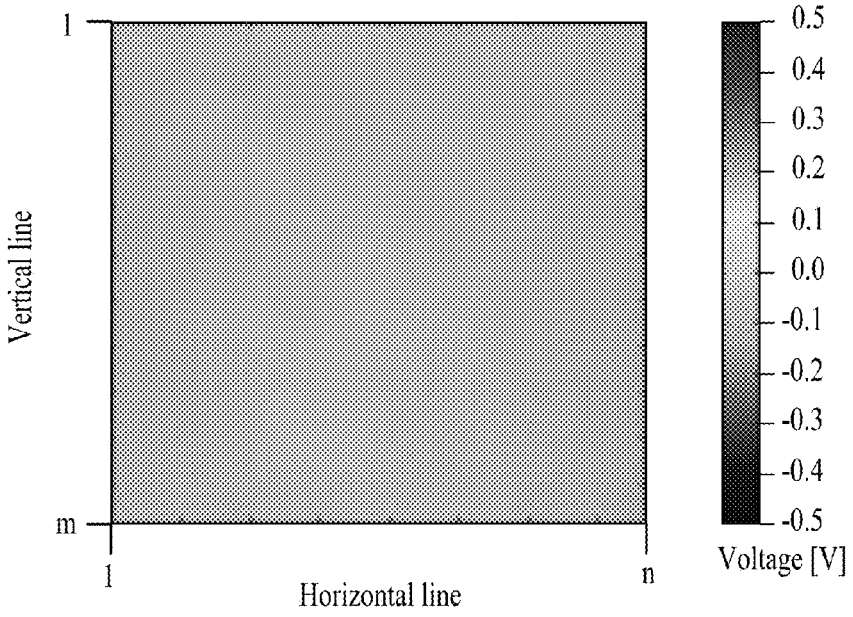

FIG. 12A and FIG. 12B show the deviation for each pixel between the threshold voltage sensed at the shortened sensing time and the threshold voltage sensed at the voltage saturation time in the present invention and a comparative example.

First, as shown in FIG. 12A, in case of the comparative example, the voltage deviation for each pixel between the threshold voltage sensed at the shortened sensing time and the threshold voltage sensed at the voltage saturation time is generally large by the deviation of the sensing voltage for each pixel in accordance with the mobility deviation of the driving transistor occurring at the shortened sensing time.

As shown in FIG. 12B, in case of the present invention, the shortened sensing method and the threshold voltage prediction compensation function including the mobility sensing value (α) for each pixel are applied so that it is possible to compensate for the deviation of the sensing voltage for each pixel in accordance with the mobility deviation of the driving transistor occurring at the shortened sensing time, whereby the deviation for each pixel between the threshold voltage sensed at the shortened sensing time and the threshold voltage sensed at the voltage saturation time is generally small. The scale on the right side of the figure is the same as that for FIG. 12A, described above.

In the organic light emitting display device according to the embodiment of the present invention, even though the driving characteristic value of the driving transistor for each pixel is sensed at the shortened sensing time, it is possible to realize the same effect as the threshold voltage sensing at the voltage saturation time.

According to the present invention, the driving characteristic value for each pixel is sensed at the shortened sensing time which is preset before the voltage saturation time of the sensing voltage so that it is possible to shorten the sensing time of the driving transistor for each pixel.

Also, the driving characteristic value for each pixel is compensated by predicting the driving characteristic value for each pixel at the voltage saturation time through the use of driving characteristic value for each pixel sensed at the shortened sensing time so that it is possible to compensate for the mobility deviation of the driving transistor for each pixel caused by the shortened sensing time, thereby improving luminance uniformity of the display panel.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting display device, comprising:

a display panel including a plurality of pixels, wherein each pixel includes a driving transistor outputting a data current from a data voltage to emit light from an organic light emitting diode; and a panel driver for driving the display panel in a sensing mode and a display mode, wherein, in the sensing mode, the panel driver calculates a threshold voltage prediction value of the driving transistor for each pixel by sensing a mobility and a threshold voltage of the driving transistor for the pixel through a reference line connected to a sensing node between the driving transistor and the organic light emitting diode of the pixel, wherein, in the display mode, the panel driver drives each pixel based on the threshold voltage prediction value of the pixel, and wherein the panel driver senses the mobility and the threshold voltage of the driving transistor at a shortened sensing time before a voltage saturation time at which a sensing voltage in accordance with a current flowing in the driving transistor is saturated, and calculates the threshold voltage prediction value for each pixel corresponding to the voltage saturation time on the basis of a threshold voltage sensing value of the driving transistor for each pixel, a mobility sensing value of the driving transistor for each pixel, and a capacitance of the reference line.

2. The organic light emitting display device according to claim 1, wherein the panel driver calculates the threshold voltage prediction value of the driving transistor for each pixel using the mobility sensing value and the threshold voltage sensing value of the driving transistor for each pixel, a differential voltage between gate and source voltages of the driving transistor at the shortened sensing time, the capacitance of the reference line, a sensing data voltage applied to a gate electrode of the driving transistor in the sensing mode, a pre-charging voltage applied to the reference line before the shortened sensing time, and the shortened sensing time.

3. The organic light emitting display device according to claim 1, wherein the panel driver calculates the threshold voltage prediction value (Vth') of the driving transistor for each pixel using a first Math Formula, $$Vth' = Vgs(t) - \frac{1}{\frac{1}{\mathrm{Vdata_sen} - Vpre - \mathrm{Vth_sen}} + \frac{\alpha}{Cref}t},$$

wherein 'Vgs(t)' is a differential voltage between gate and source voltages of the driving transistor at the shortened sensing time, 'Vdata_sen' is a sensing data voltage applied to a gate electrode of the driving transistor, 'Vpre' is a pre-charging voltage applied to the reference line before the shortened sensing time, 'Vth_sen' is the threshold voltage sensing value of the driving transistor, 'α' is the mobility sensing value of the driving transistor, 'Cref' is the capacitance of the reference line, and 't' is the shortened sensing time.

4. The organic light emitting display device according to claim 3, wherein the panel driver calculates a final threshold voltage prediction value by repeating the operation of the first Math Formula two or more times using the threshold voltage prediction value (Vth') for each pixel, which is calculated by the first Math Formula, as the threshold voltage sensing value (Vth_sen) for each pixel.

5. The organic light emitting display device according to claim 1, wherein the panel driver calculates the threshold voltage prediction value of the driving transistor for each pixel using a mobility offset value preset based on the mobility sensing value of the driving transistor for each pixel.

6. The organic light emitting display device according to claim 5, wherein the panel driver calculates the threshold voltage prediction value (Vth') of the driving transistor for each pixel using a second Math Formula, $$Vth' = Vgs(t) - \frac{1}{\frac{1}{\mathrm{Vdata_sen} - Vpre - \mathrm{Vth_sen}} + \frac{\alpha}{Cref}t} + n,$$

wherein 'Vgs(t)' is a differential voltage between the gate and source voltages of the driving transistor at the shortened sensing time, 'Vdata_sen' is the sensing data voltage applied to the gate electrode of the driving transistor, 'Vpre' is the pre-charging voltage applied to the reference line before the shortened sensing time, 'Vth_sen' is the threshold voltage sensing value of the driving transistor, 'α' is the mobility sensing value of the driving transistor, 'Cref' is the capacitance variable of the reference line, 't' is the shortened sensing time, and 'n' is the mobility offset value in accordance with the mobility sensing value of the driving transistor.

7. The organic light emitting display device according to claim 6, wherein the panel driver calculates a final threshold voltage prediction value for each pixel by repeating the operation of the second Math Formula two or more times by using the threshold voltage prediction value (Vth') for each pixel, which is calculated by the second Math Formula, as the threshold voltage sensing value (Vth_sen) for each pixel.

8. The organic light emitting display device according to claim 6, wherein the mobility offset value is an operation value of a linear function using the mobility sensing value of the driving transistor.

9. The organic light emitting display device according to claim 8, wherein the panel driver calculates a final threshold voltage prediction value for each pixel by repeating the operation of the second Math Formula two or more times by using the threshold voltage prediction value (Vth') for each pixel, which is calculated by the second Math Formula, as the threshold voltage sensing value (Vth_sen) for each pixel.

10. A method of driving an organic light emitting display device, the display device including a display panel and a panel driver, and the display panel includes a plurality of pixels, each pixel including a driving transistor and an organic light emitting diode, the method comprising:

in a sensing mode, calculating a threshold voltage prediction value of a driving transistor for each pixel by sensing a mobility and a threshold voltage of the driving transistor for the pixel through a reference line connected to a sensing node between the driving transistor and an organic light emitting diode of the pixel, and, in a display mode, the panel driver drives each pixel based on the threshold voltage prediction value of the pixel, wherein the panel driver senses the mobility and the threshold voltage of the driving transistor at a shortened sensing time before a voltage saturation time at which a sensing voltage in accordance with a current flowing in the driving transistor is saturated, and calculates the threshold voltage prediction value for each pixel corresponding to the voltage saturation time on the basis of a threshold voltage sensing value of the driving transistor for each pixel, a mobility sensing value of the driving transistor for each pixel, and a capacitance of the reference line.

11. The method according to claim 10, wherein the panel driver calculates the threshold voltage prediction value of the driving transistor for each pixel using the mobility sensing value and the threshold voltage sensing value of the driving transistor for each pixel, a differential voltage between gate and source voltages of the driving transistor at the shortened sensing time, the capacitance of the reference line, a sensing data voltage applied to a gate electrode of the driving transistor in the sensing mode, a pre-charging voltage applied to the reference line before the shortened sensing time, and the shortened sensing time.

12. The method according to claim 10, wherein the panel driver calculates the threshold voltage prediction value (Vth') of the driving transistor for each pixel using a first Math Formula, $$Vth' = Vgs(t) - \frac{1}{\frac{1}{\mathrm{Vdata_sen} - Vpre - \mathrm{Vth_sen}} + \frac{\alpha}{Cref}t},$$

wherein 'Vgs(t)' is a differential voltage between gate and source voltages of the driving transistor at the shortened sensing time, 'Vdata_sen' is a sensing data voltage applied to a gate electrode of the driving transistor, 'Vpre' is a pre-charging voltage applied to the reference line before the shortened sensing time, 'Vth_sen' is the threshold voltage sensing value of the driving transistor, 'α' is the mobility sensing value of the driving transistor, 'Cref' is the capacitance of the reference line, and 't' is the shortened sensing time.

13. The method according to claim 12, wherein the panel driver calculates a finally-obtained threshold voltage prediction value by repeating the operation of the first Math Formula two or more times using the threshold voltage prediction value (Vth') for each pixel, which is calculated by the first Math Formula, as the threshold voltage sensing value (Vth_sen) for each pixel.

14. The method according to claim 10, wherein the panel driver calculates the threshold voltage prediction value of the driving transistor for each pixel using a mobility offset value preset based on the mobility sensing value of the driving transistor for each pixel.

15. The method according to claim 14, wherein the panel driver calculates the threshold voltage prediction value (Vth') of the driving transistor for each pixel by the following second Math Formula, $$Vth' = Vgs(t) - \frac{1}{\frac{1}{\mathrm{Vdata_sen} - Vpre - \mathrm{Vth_sen}} + \frac{\alpha}{Cref}t} + n,$$

wherein 'Vgs(t)' is a differential voltage between the gate and source voltages of the driving transistor at the shortened sensing time, 'Vdata_sen' is the sensing data voltage applied to the gate electrode of the driving transistor, 'Vpre' is the pre-charging voltage applied to the reference line before the shortened sensing time, 'Vth_sen' is the threshold voltage sensing value of the driving transistor, 'α' is the mobility sensing value of the driving transistor, 'Cref' is the capacitance variable of the reference line, 't' is the shortened sensing time, and 'n' is the mobility offset value in accordance with the mobility sensing value of the driving transistor.

16. The method according to claim 15, wherein the panel driver calculates the finally-obtained threshold voltage prediction value for each pixel by repeating the operation of the second Math Formula two or more times by using the threshold voltage prediction value (Vth') for each pixel, which is calculated by the second Math Formula, as the threshold voltage sensing value (Vth_sen) for each pixel.

17. The method according to claim 15, wherein the mobility offset value is an operation value of a linear function using the mobility sensing value of the driving transistor.

18. The method according to claim 17, wherein the panel driver calculates the finally-obtained threshold voltage prediction value for each pixel by repeating the operation of the second Math Formula two or more times by using the threshold voltage prediction value (Vth') for each pixel, which is calculated by the second Math Formula, as the threshold voltage sensing value (Vth_sen) for each pixel.

19. A panel driver for driving a display panel in a sensing mode and a display mode, comprising:

a timing controller for driving a row driver and a column driver of the display panel;

the row driver for generating and supplying scan pulses to scan lines of the display panel based on a row driver control signal from the timing controller;

the column driver for supplying data voltage to data lines of the display panel based on a column driver data control signal from the timing controller in the display mode, and sensing a mobility and threshold voltage of a driving transistor for each of a plurality of pixels of the display panel based on a column driver sense control signal from the timing controller and supplying a mobility sensing value and a threshold voltage sensing value for each pixel to the timing controller in the sensing mode; and a memory in communication with the timing controller for storing the mobility sensing value and the threshold voltage sensing value, wherein, in the sensing mode, the timing controller calculates a threshold voltage prediction value of the driving transistor for each pixel using the mobility and the threshold voltage of the driving transistor for the pixel, wherein, in the display mode, the panel driver drives each pixel based on the threshold voltage prediction value of the pixel, wherein the mobility and the threshold voltage of the driving transistor of each pixel are sensed at a shortened sensing time before a voltage saturation time at which a sensing voltage in accordance with a current flowing in the driving transistor is saturated, and wherein the timing controller calculates the threshold voltage prediction value for each pixel corresponding to the voltage saturation time on the basis of the threshold voltage sensing value of the driving transistor of the pixel, the mobility sensing value of the driving transistor of the pixel, and a capacitance of a reference line connected to a sensing node of the pixel.

20. The panel driver according to claim 19, wherein in the sensing mode the display panel is driven during a first time period to initialize each pixel with a pre-charging voltage, a second time period to drive the driving transistor of each pixel to saturation and, a third time period to sense a voltage of the reference line of each pixel, and wherein in the display mode each pixel is driven during an addressing period providing a differential voltage between a data voltage and a reference voltage to pre-charge the pixel, and during a light emission period providing data current based on the differential voltage to an organic light emitting diode.

* * * * *